United States Patent [19]

Bunce et al.

[11] 4,369,664

[45] Jan. 25, 1983

[54] PIPETTE MEANS

[75] Inventors: Roger A. Bunce, Bourneville; John E. C. Gibbons, Stirchley; Larry J. Kricka, Bourneville, all of England

[73] Assignee: National Research Development Corporation, London, England

[21] Appl. No.: 200,583

[22] Filed: Oct. 24, 1980

[30] Foreign Application Priority Data

Oct. 31, 1979 [GB] United Kingdom ..... 7937750

[51] Int. Cl.[3] ..... B01L 3/02

[52] U.S. Cl. ..... 73/864.12; 73/864.11; 222/207; 222/214; 422/100

[58] Field of Search ..... 422/100, 81, 82, 63, 422/64, 65, 67; 73/864.12, 864.21, 864.22; 222/136, 135, 145, 214, 207

[56] References Cited

U.S. PATENT DOCUMENTS

| | | | |
|---|---|---|---|
| 2,791,969 | 5/1957 | Berliner | 103/148 |
| 2,810,351 | 10/1957 | Bower | 103/140 |
| 3,007,416 | 11/1961 | Childs | 103/44 |
| 3,367,746 | 2/1968 | Maurukas . | |
| 3,476,518 | 11/1969 | Jungner | 73/864.12 |
| 3,484,207 | 12/1969 | Anthon | 73/864.12 |
| 3,525,592 | 8/1970 | Buckley | 73/864.12 |
| 3,598,508 | 8/1971 | Reid et al. | 417/400 |
| 3,877,609 | 4/1975 | Cullis | 222/1 |
| 4,030,640 | 6/1977 | Citrin et al. | 222/214 |

FOREIGN PATENT DOCUMENTS

| | | | |
|---|---|---|---|
| 2120719 | 12/1971 | Fed. Rep. of Germany | 422/100 |
| 2425613 | 12/1975 | Fed. Rep. of Germany . | |
| 1281309 | 12/1961 | France . | |
| 1446088 | 6/1966 | France . | |
| 1572337 | 5/1969 | France . | |
| 816035M | 7/1959 | United Kingdom . | |
| 1214444 | 12/1970 | United Kingdom . | |
| 1382818 | 2/1975 | United Kingdom . | |

*Primary Examiner*—William F. Smith

*Attorney, Agent, or Firm*—Cushman, Darby & Cushman

[57] ABSTRACT

Pipette means having aspirating and expelling means and a substantially cylindrical tube connected to a pipette tip for fluid flow therebetween; the expelling means being arranged to apply pressure to the outer surface of the cylindrical tube, the diameter and wall thickness of which being chosen so that said tube is compressed elastically and substantially uniformly and circumferentially to reduce the internal volume thereof, tending to expel any liquid from the pipette tip; and the aspirating means being arranged to relieve pressure from the outer surface of said tube, allowing the tube to expand substantially circumferentially and uniformly so that liquid may thereby be drawn into the pipette tip.

6 Claims, 11 Drawing Figures

PIPETTE MEANS

BACKGROUND AND SUMMARY OF THE INVENTION

This invention relates to pipette means, more especially, but not exclusively, of an at least partially atomated kind, having the object of improving the consistency of sampling and dispensing volume, and of dilution ratio, by eliminating a measure of human error from these operations.

The traditional form of pipette in which a sample is aspirated by lung power and expelled by the same means, or by gravity, can be accurate for sample quantities of the order of as little as 5 milliliter. Many projects, for example in connection with analysis of biological fluids, require the moving of hundreds or thousands of samples usually of the order of 5 microliter, and often also their dilution. Some degree of automation is necessary on grounds of time, accuracy and consistency; and apparatus exists which can automatically aspirate and dispense with high accuracy and consistency. However, such apparatus has usually been expensive, including, for example, precision syringes for sample measurement. The present invention permits at least as good accuracy and consistency to be achieved, using components which are cheap and even, in some instances, expendable.

According to the invention pipette means has aspirating and expelling means and a substantially cylindrical tube connected to a pipette tip for fluid flow therebetween; the expelling means being arranged to apply pressure to the outer surface of the cylindrical tube, the diameter and wall thickness of which being chosen so that said tube is compressed elastically and substantially uniformly and circumferentially to reduce the internal volume thereof, tending to expel any liquid from the pipette tip; and the aspirating means being arranged to relieve pressure from the outer surface of said tube allowing the tube to expand substantially circumferentially and uniformly so that liquid may thereby be drawn into the pipette tip.

The expelling and aspirating means may operate by the application and relief respectively of fluid pressure to and from the cylindrical tube.

In one embodiment of the invention the pipette means is arranged for sampling, diluting and dispensing, and has diluent valve means which permit a controlled amount of liquid diluent to pass through the cylindrical tube to the pipette tip to dilute a sample when the expelling means applies pressure to the cylindrical tube.

The diluting means may include a diluent syringe, diluent valve means and syringe operating means; arranged so that when the cylindrical tube aspirates a sample into the pipette tip the syringe draws diluent from a reservoir; and after reaching the end of its stroke the syringe drives its charge of diluent through the cylindrical tube and out of the pipette tip.

The syringe operating means may be a piston and cylinder combination, the stroke of the piston being longer than the stroke of the syringe, and the excess stroke of the piston being adapted to operate the diluent valve means at the end of each stroke of the syringe.

Another from of syringe operating includes an electric motor driving a lead screw connected to the syringe plunger, arranged so that at each end of the stroke of the syringe relative rotary movement between the body of the electric motor and the lead screw operates the diluent valve means.

In the pipette means, the aspirating and expelling means may include, for operation thereof, valve means and fluid pressure control means, the valve means being adapted to apply pressure to and release pressure from the cylindrical tube, the pressure being supplied, in use, from an external source of fluid pressure.

As an alternative to reliance on an external source of fluid pressure, the pipette means may be adapted for the inclusion of a source of fluid pressure which may be a miniature gas storage cylinder of carbon dioxide.

It may be arranged that the source of fluid pressure for the pipette means is also the source of diluent, which may for that purpose be a pressurised reservoir.

In another arrangement, the source of diluent is a head tank arranged, in use, at a level above the cylindrical tube, which level provides pressure adequately to compress said cylindrical tube.

Desirably the head tank is provided with liquid levelling means for keeping the liquid level therein substantially constant. Such means may be, for example, spring means supporting the head tank, said spring means being so proportioned that as liquid is withdrawn from the tank the spring means, experiencing a smaller force, raises the tank so that the liquid level therein is kept constant above a predetermined datum.

In the pipette means, any valve means may include a valve of the electrical solenoid operated kind; and may further including timing means arranged to control the sequence and timing of operation of any such valve.

In another embodiment the pipette means has valve means and a reservoir, the valve means being arranged so that in a first position thereof pressure is removed from the cylindrical tube to aspirate a sample into the pipette tip and the reservoir is charged with fluid pressure from a source thereof, and in another position pressure is applied to the cylindrical tube to compress it, and the reservoir is discharged through the cylindrical tube, at least to assist in expelling the sample from the pipette tip.

In a further embodiment, the diluent may be stored in a pressurised reservoir, and the quantity delivered through the cylindrical tube controlled by a timer and solenoid operated valve.

The cylindrical tube may be made of latex rubber. If low absorption of water by the tube is specially desirable, the cylindrical tube may be latex rubber, lined with a thin layer of silicone rubber. A further possibility is to make the cylindrical tube of a mixture of silicone rubber and natural rubber.

Desirably, exhausting of fluid from around the cylindrical tube is controlled in rate, eg by an adjustable needle valve. If required, the temperature of the pipette means, and of fluids supplied to it, may be controlled thermostatically. As an alternative to fluid pressure, compression and expansion of the cylindrical tube may be by alternately tightening and releasing a coaxial helical filament.

What has been referred to in the foregoing as a "cylindrical tube" is also referred to in the specification as a "squashed tube"; although in the working of the invention the tube is not squashed, in the usual meaning of the word, that is to say the tube is not flattened in use, but retains its circular cross section.

BRIEF DESCRIPTION OF THE DRAWING

The invention will be further described, by way of example, with reference to the accompanying drawings.

In the drawings

DETAILED DESCRIPTION OF THE PREFERRED EXEMPLARY EMBODIMENTS

Figure 1:
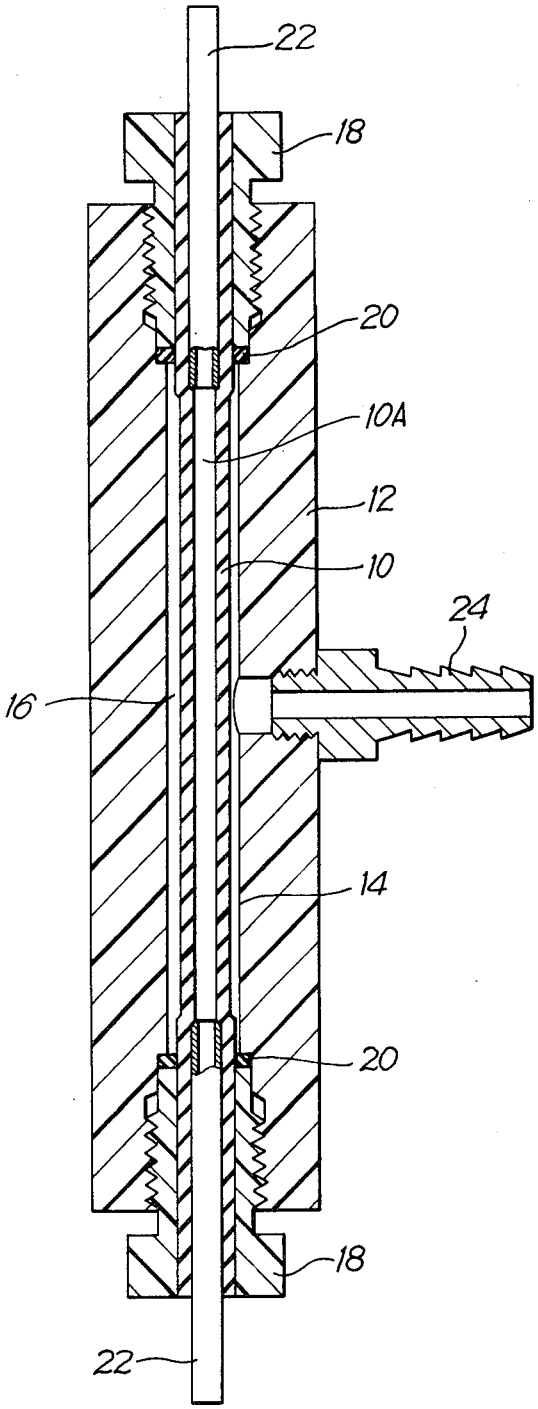
FIG. 1 illustrates a squashed tube unit

An essential feature of the invention is a compressible cylindrical tube, or squashed tube, and a squashed tube unit is illustrated in FIG. 1. The squashed tube is indicated by reference 10. It is preferably made of good quality latex rubber, for good elastic properties, and for good consistency of results is thick walled. The wall thickness is typically half the inside diameter, but a greater ratio could be used. The squashed tube is housed in a block 12 having an internal bore 14 of greater diameter than the outside diameter of the squashed tube. The intervening space is referenced 16. The tube 10 is located and sealed in the block 12 by threaded glands 18, O-rings 20 and connecting tubes 22. Fluid connection to the space 16 is made through the connector 24 from a source of fluid pressure, which, in some embodiments may be pressurised gas and in others liquid under pressure. By increasing fluid pressure in the space 16 the tube 10 is compressed uniformly, elastically and in the circumferential direction, so that the cross section of the tube 10 remains annular and is not flattened. This is necessary in order to ensure that for a given change in pressure in the space 16 the internal volume of the tube 10 always changes by the same amount, giving repeatable sample volumes over a large number of cycles of aspiration and expulsion. The tube 10 is first compressed by the application of pressure in space 16; removal of the pressure allows a sample of liquid to be aspirated at a pipette tip; and reapplication of pressure expels the sample (other means may be used to aid the expulsion) and readies tube 10 for aspiration of a further sample. The block 12 may be made of acrylic plastics material in tube shape, and the connecting tubes 22 are conveniently made of stainless steel. The volume change of the interior of tube 10 depends on the external fluid pressure applied and relieved, the temperature, the cross-sectional dimensions and elastic properties of the material of tube 10, and the length of tube 10 between connecting tubes 22.

Figure 2:
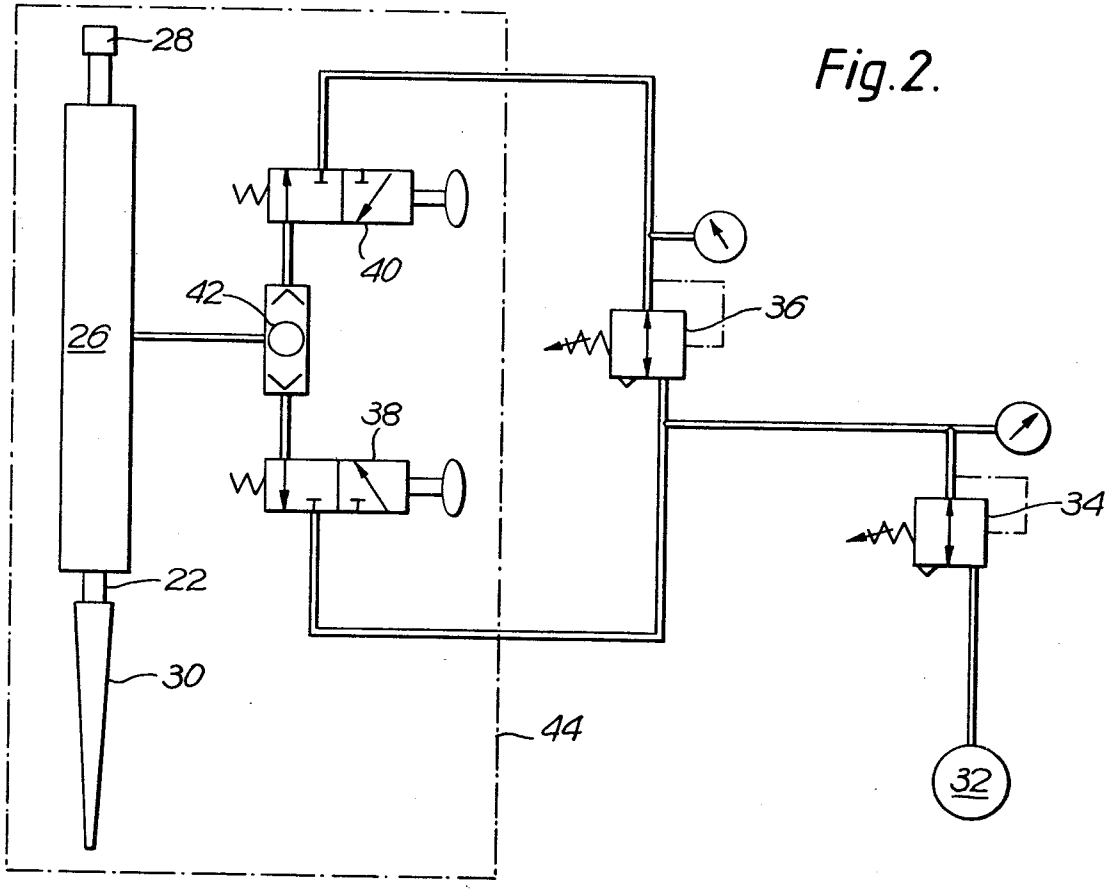
FIG. 2 illustrates pipette means having dual pressure operation

FIG. 2 illustrates diagrammatically a first embodiment of the invention. It is a pipette means which, if required can be arranged to be hand held, and can be used for aspirating a liquid sample from one vessel and expelling it into another. The squashed tube unit is indicated generally by reference 26. In this embodiment the top connecting tube is sealed by a plug or cap 28, and the lower connection 22 is taken to a pipette tip 30. A source of fluid pressure is indicated at 32. A constant operating pressure of 10 p sig (about 0.067 MN $m^{-2}$) is provided by a precision reducing valve 34. A second constant working pressure of 5 psig (about 0.033 MN $m^{-2}$) is provided by a second precision reducing valve 36. The two fluid pressures are applied alternatively to the squashed tube unit by means of two manually operated valves 38, 40 and a shuttle valve 42. In taking a liquid sample, the valve 40 is operated to apply the lower pressure to the squashed tube unit and to compress the tube. The pipette tip 30 is then dipped into the liquid to be sampled and the valve 40 again operated to release the lower pressure to draw a sample of liquid into the pipette tip. The pipette tip is positioned over a receiving vessel, and the valve 38 operated to apply the higher fluid pressure to the squashed tube unit 26, so expelling the liquid sample into the receiving vessel. The valve 40 is operated to apply the lower fluid pressure to the squashed tube again, making the pipette means ready to aspirate another liquid sample. In a hand held arrangement that part of the apparatus shown enclosed by the dashed line 44 may be contained in a single unit for holding in one hand.

Figure 3:
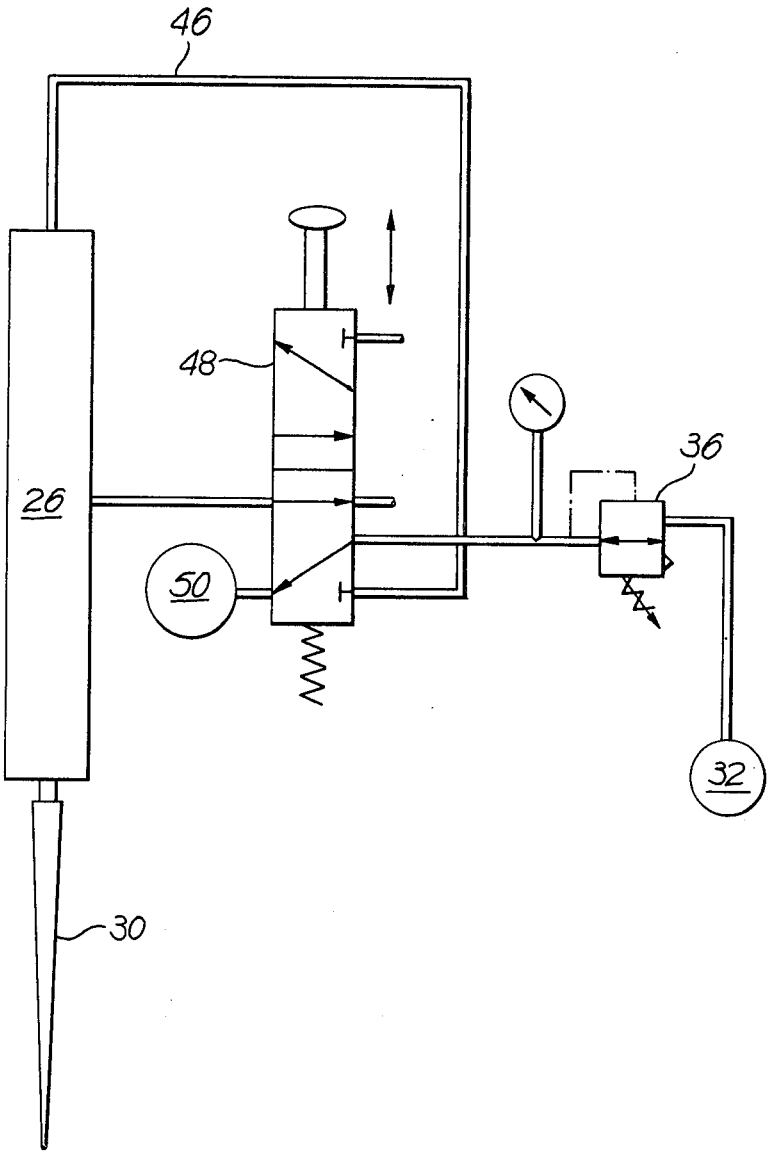
FIG. 3 illustrates pipette means having single pressure operation

FIG. 3 illustrates pipette means which can be operated from a source of fluid pressure at a single pressure, say 5 psig. The top connection to the squashed tube unit 26, instead of being capped, as shown in FIG. 2, is connected to a tube 46. Fluid pressure is supplied from a source 32, through a reducing valve 36, to manually operated valve means 48, which connects to the squash unit 26, the tube 46, and a small fluid reservoir 50. In the position of valve 48 illustrated, the reservoir is charged from the source 32. Operation of valve 48, by depression thereof, exhausts the contents of the reservoir through tube 46 and so through the squashed tube and pipette tip, 30; and at the same time the squashed tube is compressed. The pipette tip is then dipped into a liquid to be sampled and the valve 48 operated in the opposite sense to allow pressure to be relieved from the squashed tube, aspirating a liquid sample. At the same time the reservoir is recharged. The pipette tip is positioned over a receiving vessel, and the valve 48 again depressed, compressing the squashed tube and discharging the reservoir to expel the sample from the pipette tip.

Figure 4:
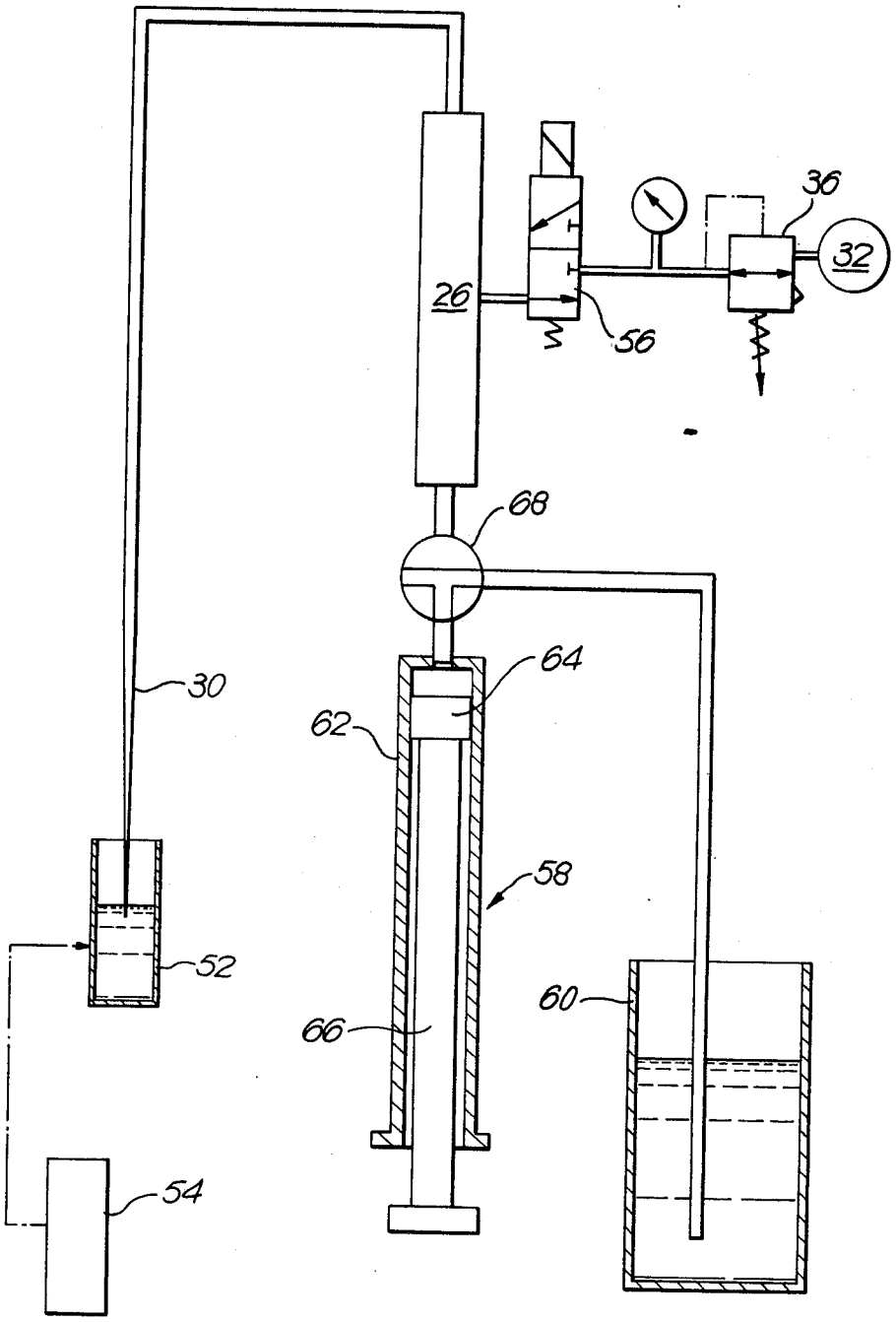
FIG. 4 illustrates pipette means for sampling, diluting and dispensing

FIG. 4 illustrates pipette means for sampling, diluting and dispensing. This implies that a sample of a liquid is aspirated from a first vessel 52; a diluent (usually water) is added to it, and the diluted sample is dispensed into a receiving vessel 54. The squashed tube unit 26 is operated from fluid pressure source 32 via a reducing valve 36 and a solenoid operated valve 56. With the valve 56 energised, the squashed tube in unit 26 is compressed. The pipette tip 30 is dipped into liquid in vessel 52. De-energizing valve 56 relieves the pressure in the squashed tube and a sample is aspirated from vessel 52. At the same time that a sample is being aspirated into the pipette tip, the syringe 58 is operated to draw in a predetermined quantity of diluent from a storage vessel 60. The syringe has a barrel 62, a plunger 64, and plunger rod 66. The syringe is connectable alternatively to the diluent storage vessel 60 and to the squashed tube unit 26 by a three way valve 68. In the position of the three way valve illustrated, the plunger 64 is withdrawn and diluent is drawn into the barrel 62, to the predetermined quantity. At the end of the outer stroke of the plunger 64, the valve 68 is rotated through a quarter of a turn in a clockwise sense, connecting the syringe to the squashed tube unit 26. The receiving vessel 54 is substituted for the vessel 52, pressure is reapplied to the unit 26 by energizing the valve 56, and the plunger 64 is driven in, expelling sample and diluent into the vessel 54. At the end of the inward stroke of the plunger 64, the valve 68 is rotated back to the position shown, so that the cycle can be repeated.

The syringe 58 and valve 68 may be operated manually and coordinated with the operation of the squashed tube unit 26. Better consistency of results in sampling, diluting and dispensing can be achieved by a measure of mechanisation. One way in which this may be achieved is through operating the syringe 58 and valve 68 by a piston and cylinder combination, referenced 70 in FIG. 5. The piston and cylinder combination 70, and the syringe barrel 62, are both anchored to an abutment indicated diagrammatically by reference 72. The combination 70 is provided with a piston rod 74 which is fixed to the outer extremity of the plunger rod 66 by a cross-head 76. The combination 70 has a forked operating arm 78 which engages a pin 80 on the rotatable portion of the three way valve 68; the combination is supported from the abutment 72 by a friction clamp 82. Pressurised fluid, eg air, is supplied to the piston and cylinder combination from a source 84 through a four way valve 86. The valve 86 is operable by motor means 88 from a timing and controlling device, indicated diagrammatically at 90, which may include limit switches (not illustrated) operable by the combination 70 and piston rod 74.

Figure 5:
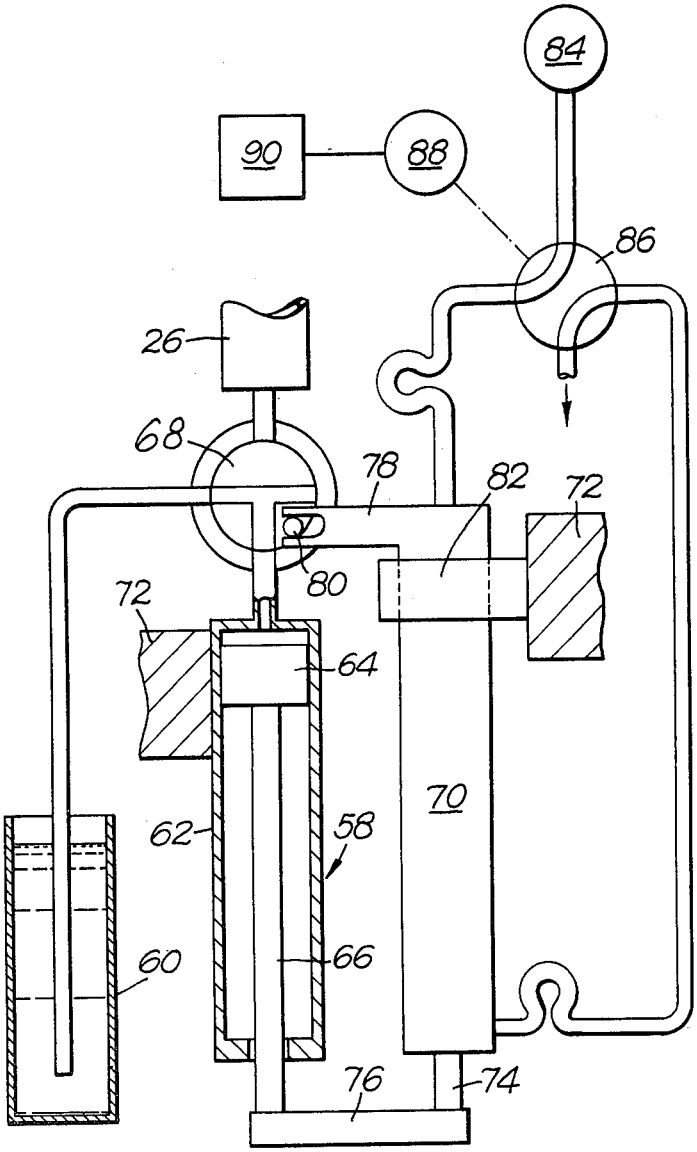
FIG. 5 illustrates air cylinder operation for a syringe

FIG. 5 shows the commencement of the outer stroke of plunger 64 of the syringe, which is then connected to the diluent storage vessel 60. Air is admitted above the piston in combination 70 and the piston, and hence the plunger 64, are driven out (down, as illustrated). When the plunger 64 reaches the end of its permissible outstroke the piston in combination 70 can still travel further in the cylinder. To do that the friction of clamp 82 is overcome and the upper (as illustrated) end of the cylinder moves up, and through the arm 78 and pin 80 rotates valve 68 so as to connect the syringe to the squashed tube unit 26. The controller 90 actuates change over of valve 86 to admit air under the piston. The frictional force on the plunger 64 is appreciably less than that between the cylinder and the clamp 82. Hence the valve 68 remains in the position to connect syringe to squashed tube until the plunger reaches its fully-in position. Movement of the cylinder then returns the valve 68 to the position illustrated, ready for a further cycle.

Figure 6:
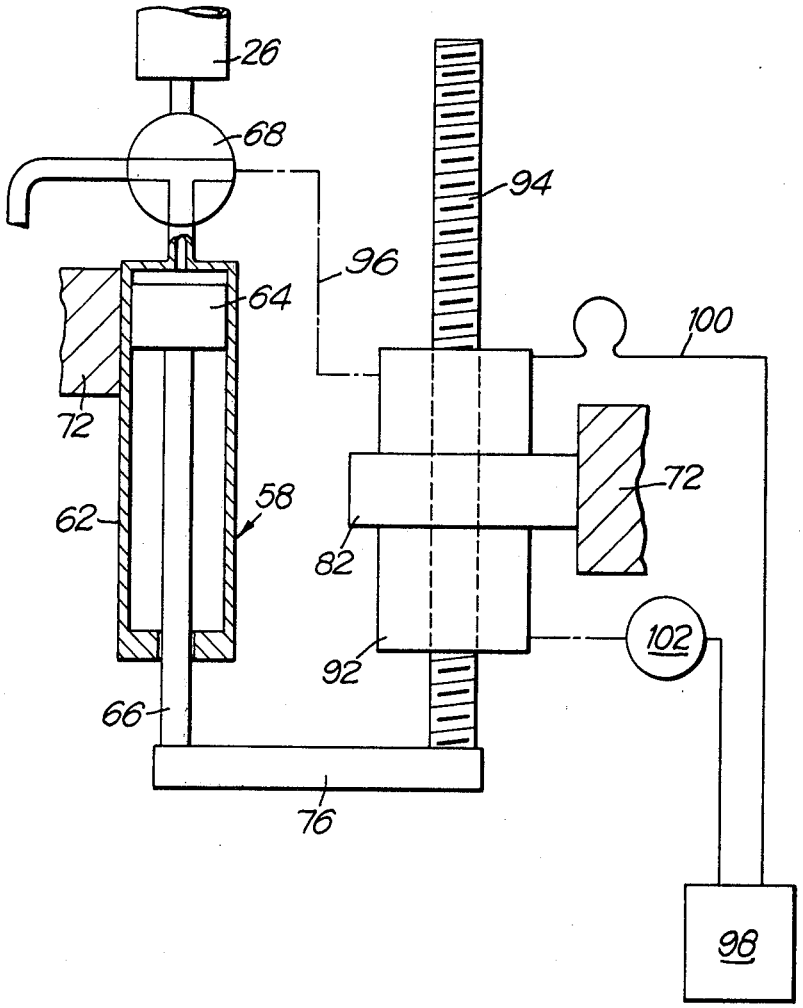
FIG. 6 illustrates lead screw operation for a syringe

FIG. 6 illustrates an alternative means for operating the syringe 58. In place of an air operated piston and cylinder combination, an electric motor 92 and lead screw 94 are provided for moving the syringe plunger 64 in and out in the barrel. When the plunger comes to the end of its stroke in either direction, the friction of the valve 68 is overcome and the motor as a whole rotates through a part of a rotation to operate the valve 68 in the appropriate sense through a link indicated diagrammatically by 96. The link 96 may suitably comprise mechanical means such as have already been described in relation to the embodiment of FIG. 5. The motor 92 is controlled from control means 98, through flexible leads 100. The motor operates limits switches at each end of its travel, and these are indicated diagrammatically by 102. The limit switches may be of conventional kind in which a flag can interrupt a light beam directed onto a photo electric device.

Figure 7:
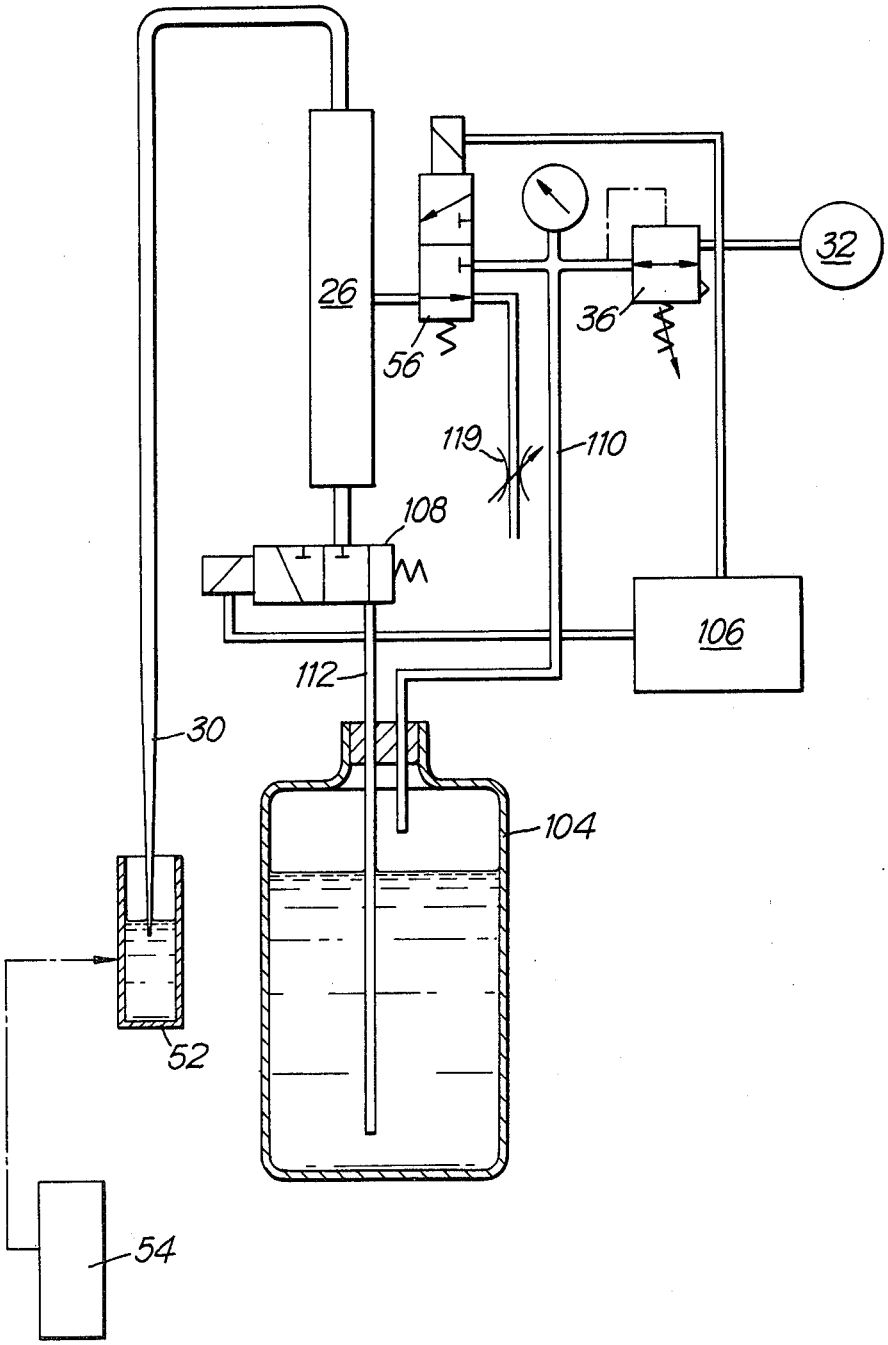
FIG. 7 illustrates pipette means having a pressurised reservoir and solenoid operated valves

FIG. 7 illustrates pipette means having a pressurised reservoir 104 for diluent; the valving being electrically controlled from a controller and timer indicated by 106. The valves are conveniently of the solenoid operated kind. In this embodiment a syringe and its operating gear are not required. The controller 106 first energises valve 56 to apply pressure from souce 32, through reducer 36, at about 5 psig to the squashed tube unit 26. The pipette tip 30 is dipped into the sample vessel 52, after which the pressure on the squashed tube is relieved so as to aspirate a sample of liquid. The pipette tip is positioned over vessel 54 and the controller 106 then energises valve 108 to open it and allow diluent from the reservoir 104 to be driven by fluid pressure, applied through tube 110, through tube 112 and with the sample through the squashed tube and pipette tip into vessel 54. During the time diluent flows, the valve 56 is energised. When a required quantity of diluent has passed, the controller 106 de-energises the valve 108 ready for a further cycle.

Figure 8:
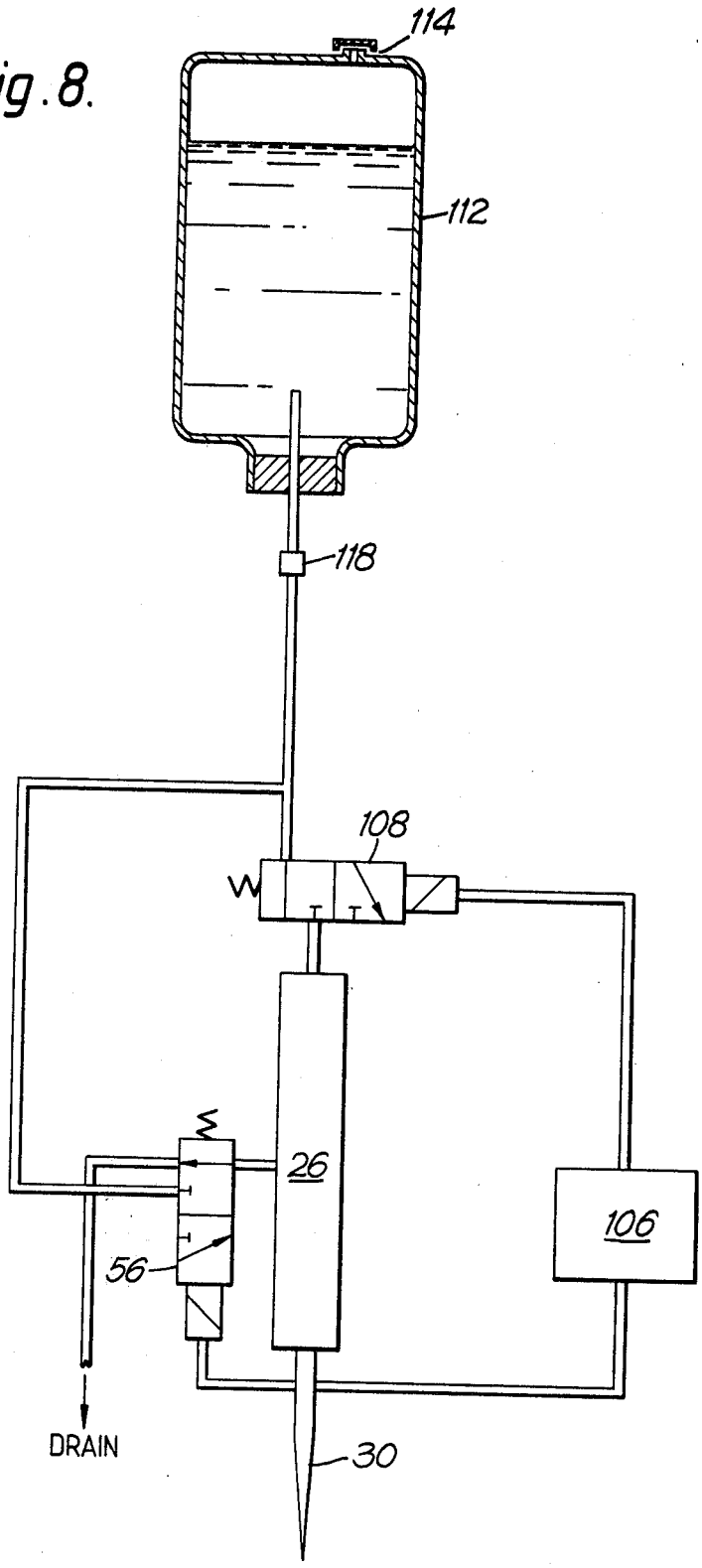
FIG. 8 illustrates pipette means having fluid pressure supplied by head of diluent

FIG. 8 illustrates pipette means in which fluid pressure for operating the squashed tube is provided by the diluent in a diluent reservoir or head tank 112 arranged at a suitable height above the squashed tube unit. A height of about $1\frac{1}{2}$ to 2 meter is suitable. A vent for the reservoir is provided at 114. The valves 56 and 108 are operated in sequence by a controller and timer 106, in a manner similar to that described for the embodiment of FIG. 7.

The embodiments of both FIGS. 7 and 8 are readily rearrangeable as hand-held devices; in each case the items 26, 30, 56 and 108 being arranged in a single hand held unit. Where small liquid quantities are concerned, it is possible also to include the reservoir 104 of FIG. 7.

The embodiment of FIG. 7 is dependent for accuracy and consistency of results on an accurately maintained gas pressure and accurate timing of opening and closing of valves. Since the same pressure reducing valve pressurises the diluent reservoir and operates the squashed tube unit there is a measure of compensation in the dilution ratio. A doubling of gas pressure, for example, produces a change of about 33% in diluent to sample ratio.

Figure 9:
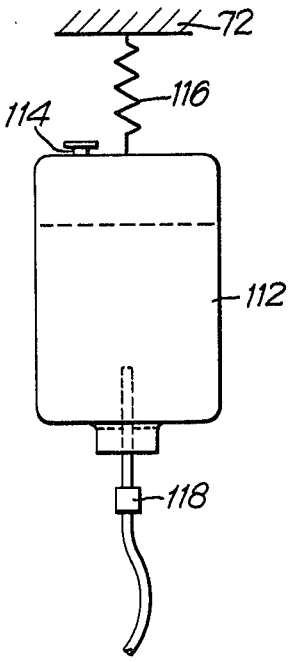
FIG. 9 illustrates a head tank for diluent, supported by a spring.

The embodiment of FIG. 8 is dependent for accuracy on maintenance of a constant head in reservoir 112 in relation to the squashed tube unit 26. A constant head can be held wth reasonable accuracy for a short time by making the reservoir 112 with a large cross sectional area. Better accuracy can be obtained by applying the "chicken feeder" principle, with an inverted tank having its outlet dipping just under the surface of liquid in the reservoir 112. FIG. 9 illustrates a further construction, in which the reservoir 112 is supported by a spring 116 from a rigid abutment 72. By suitably proportioning the spring in relation to the weight of the reservoir it can be arranged that as liquid is withdrawn, the spring shortens by just a sufficient amount to keep the liquid level constant above a predetermined datum. Spring support may also be applied to a reservoir which is pressurised by a gas supply. In the case of gravity feed of diluent, as in FIGS. 8 and 9, it is found that performance is improved by the provision, just below the reservoir, of a flow restrictor 118. The restrictor conveniently reduces the pipe cross sectional area to about 1/10 to 1/20 over a small distance. The restriction is necessary to reduce over pressures introduced by operation of the valves 56 and 108.

In embodiments illustrated in FIG. 2, FIG. 3, FIG. 4 with FIG. 6, and in FIG. 7, the rate of use of pressurised fluid for operating the squashed tube unit, and in the case of FIG. 7 pressurising the diluent reservoir, is small. In these instances it is possible to use as a source of pressurised fluid a miniature gas storage cylinder of carbon dioxide, such as is available under the name of SPARKLET (RTM).

On a large number of tests, pipette means of the kind described have been found capable of giving results of good accuracy, even with operators of limited skill and experience. Percentage coefficients of variation of results in the approximate range of 0.15 to 0.3 have been obtained.

Improved precision of operation may be achieved if during aspiration of liquids into the pipette, exhausting of fluid from around the squashed tube is controlled so as not to take place too suddenly. To achieve this, the fluid being exhausted is arranged to pass through an adjustable needle valve, as exemplified at reference 119 in FIG. 7.

Figure 10:
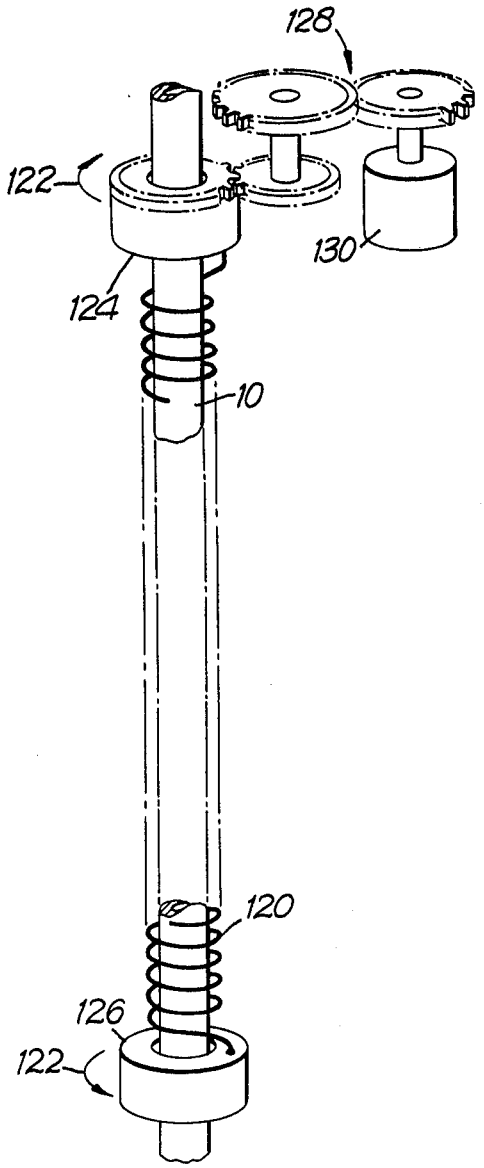
FIG. 10 illustrates alternative means for compressing a squashed tube

It has been found that with larger sizes of cylindrical tube ie those which can aspirate and expel larger quantities of liquid, a longer cycle time of compression and relaxation is required. This is due to a longer dimensional recovery time of the squashed tube after compression. It has been found that compression and expansion or relaxation of the cylindrical squashed tube may also be effected by alternately tightening and releasing a coaxial helical filament. In these circumstances the performance of the pipette means depends less on the properties of the squashed tube and to a greater extent on those of the helical filament. The arrangement is illustrated diagrammatically in FIG. 10.

The squashed tube 10 is surrounded by a helical filament 120 having a close pitch, eg about one third to one fifth of the diameter. The squashed tube is compressed by rotating the ends of the helix 120 in relation to one another in the sense indicated by the arrows 122. The squashed tube is allowed to relax again by reversing the direction of relative rotation of the ends of the helix. Each end of the helix may be fixed in a collar, 124, 126, surrounding the tube 10. One or both of the collars may be arranged to be rotatable, eg by means of a gear train 128 driven by a small electric motor 130. Alternatively the ends of the helix may be made relatively rotatable pneumatically, or by hand, mechanically.

The helix may be made of metal wire or of a stout filament of plastics material of good elastic properties. It may be made as a helical spring in order to permit complete relaxing of the helix 120 and consequent relaxation also of the tube 10. A modification, not separately illustrated, provides that the helical filament 120 is moulded into the outer part of the tube 10.

The output of the pipette means is found to vary with temperature—about 0.3% volume per °C. of temperature change—when the squashed tube is actuated by external fluid pressure. However, the construction just described, using a helical filament goes some way towards reducing the problem. As an alternative, the temperature of the pipette means, and of fluids supplied to it may be controlled thermostatically, by means which in themselves may be of conventional kind; for example by arranging the whole equipment in a constant temperature room or cupboard.

Figure 11:
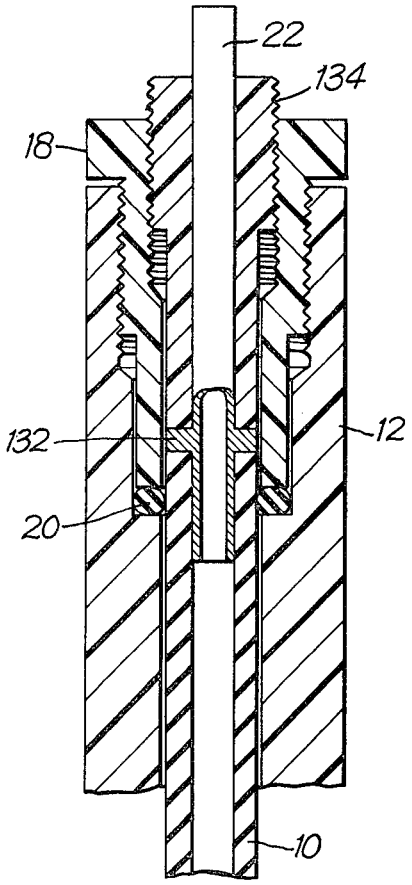
FIG. 11 illustrates a modification to the squashed tube unit shown in FIG. 1.

When squashed tubes with a large wall thickness are in use it has sometimes been found that internal pressure in the squashed tube assembly tends to push out the connecting tubes 22 (FIG. 1). This can be prevented by a modified construction illustrated in FIG. 11. As in FIG. 1, the squashed tube is indicated by 10 and the block containing it by 12. In the modified construction and the connecting tube 22 is provided with an annular flange 132. The connecting tube is retained by an end stop 134, threaded into the gland 18 and bearing on the flange 132.

Squashed tubes of latex rubber absorb moisture when continuously exposed to it. This occurs to the extent of about 0.02 $\mu$l per cubic millimeter of the squashed tube in a period of 20 hours. The absorption of moisture alters the elastic properties of the tube to some extent, tending to reduce precision of operation. This difficulty can be mitigated to a good extent by lining a latex rubber squashed tube with a layer of silicone rubber, as indicated at 10A in FIG. 1. Silicone rubber absorbs moisture only at a rate of about 0.003 $\mu$l per cubic millimeter in 20 hours. Such a layer of silicone rubber may be obtained by a dip-coating process. A futher possibility is to make a squashed tube from a mixture of natural rubber and silicone rubber. Such a material is available commercially under the name of Silkolatex (RTM).

In general it is preferable to operate the pipette means so that a slug of air is entrained between sample and diluent. This is to be preferred to operating so that liquid stops exactly at the tip of the pipette at the end of dispensing, because small changes could then allow a pendant drop to form, with consequent overdilution or contamination of a following sample. Further, interposition of an air slug provides a securing action in the pipette tip which reduces to negligible level the possibility of carry-over from one aspirated sample to the next.

We claim:

1. Pipette means having aspirating and expelling means and a substantially cylindrical tube connected to a pipette tip for fluid flow therebetween; the expelling means being arranged to apply pressure to the outer surface of the cylindrical tube, the diameter and wall thickness of which being chosen so that said tube is compressed elastically and substantially uniformly and circumferentially to reduce the internal volume thereof, tending to expel any liquid from the pipette tip; and the aspirating means being arranged to relieve pressure from the outer surface of said tube, allowing the tube to expand substantially circumferentially and uniformly so that liquid may thereby be drawn into the pipette tip; the said expelling and aspirating means operating the application and relief respectively of fluid pressure to and from the cylindrical tube; said pipette means also having means for diluting a sample including diluent valve means for permitting a controlled amount of liquid diluent to pass through the cylindrical tube to the pipette tip to dilute a sample when the expelling means applies pressure to the cylindrical tube and wherein the source of fluid pressure is the source of liquid diluent arranged as a head tank at a level about the cylindrical tube great enough to provide pressure adequately to compress the cylindrical tube.

2. Pipette means according to claim 1 in which the diluting means includes a diluent syringe and syringe operating means; arranged so that when the cylindrical tube aspirates a sample into the pipette tip the syringe draws diluent from a reservoir; and after reaching the end of its stroke the syringe drives its charge of diluent through the cylindrical tube and out of the pipette tip.

3. Pipette means according to claim 2 in which the syringe operating means is a piston and cylinder combination, the stroke of the piston being longer than the stroke of the syringe, and the excess stroke of the piston being adapted to operate the diluent valve means at the end of each stroke of the syringe.

4. Pipette means according to claim 2 in which the syringe operating means includes an electric motor driving a lead screw connected to the syringe plunger, arranged so that at each end of the stroke of the syringe relative rotary movement between the body of the electric motor and the lead screw operates the diluent valve means.

5. Pipette means according to claim 1 having liquid levelling means for keeping the liquid level in the head tank substantially constant.

6. Pipette means according to claim 5 in which the levelling means includes spring means proportional so that as liquid is withdrawn from the head tank the said spring means raises said tank so that liquid level therein is kept substantially constant above a predetermined datum.

* * * * *

UNITED STATES PATENT AND TRADEMARK OFFICE

CERTIFICATE OF CORRECTION

PATENT NO. : 4,369,664

DATED : January 25, 1983

INVENTOR(S) : BUNCE et al

It is certified that error appears in the above—identified patent and that said Letters Patent is hereby corrected as shown below:

Column 1, line 6, delete "atomated" and insert

--automated--.

Column 1, line 65, delete "from" and insert

--form--.

Column 2, line 31, delete "including" and insert

--include--.

Column 8, line 34, delete "securing" and insert

--scouring--.

Signed and Sealed this

*Thirteenth* Day of *December 1983*

[SEAL]

*Attest:*

GERALD J. MOSSINGHOFF

*Attesting Officer*

*Commissioner of Patents and Trademarks*